US006349826B1

(12) United States Patent
Kapik et al.

(10) Patent No.: US 6,349,826 B1
(45) Date of Patent: Feb. 26, 2002

(54) MEDICAL PACKAGING FABRIC WITH IMPROVED BACTERIA BARRIER

(75) Inventors: Rene Kapik, Cheshire, CT (US); Ganesh C. Deka, Duluth, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/580,758

(22) Filed: May 30, 2000

Related U.S. Application Data

(62) Division of application No. 09/080,759, filed on May 18, 1998, now abandoned.

(60) Provisional application No. 60/051,241, filed on Jun. 30, 1997.

(51) Int. Cl.[7] ..... B65D 83/10; D21F 11/00; B32B 27/14; B32B 29/00

(52) U.S. Cl. ..... 206/363; 602/41; 428/198; 428/537.5; 162/146

(58) Field of Search ..... 424/424, 425, 424/402, 404, 443, 445, 446; 604/358, 367, 365, 385.02; 206/363, 369, 370, 438, 439, 570–572; 423/198, 326, 421, 422, 913, 537.5, 340, 341, 359, 360, 362, 364, 365, 369; 162/146, 158, 168.1, 169, 179, 206, 207; 602/41, 42, 44

(56) References Cited

U.S. PATENT DOCUMENTS

| | | | |
|---|---|---|---|
| 3,169,898 | A | 2/1965 | Kazimi |
| 3,604,426 | A | 9/1971 | Erickson |
| 3,644,251 | A | 2/1972 | Wilhelmi |
| 3,766,002 | A | 10/1973 | Greif |
| 3,776,812 | A | 12/1973 | Jongetjes |
| 3,912,581 | A | 10/1975 | Fink |
| 4,007,083 | A | 2/1977 | Ring |
| 4,018,647 | A | 4/1977 | Wietsma |
| 4,121,966 | A | 10/1978 | Amano |
| 4,178,205 | A | 12/1979 | Wessling |
| 4,183,431 | A | 1/1980 | Schmidt |
| 4,189,345 | A | 2/1980 | Foster |
| 4,245,689 | A | 1/1981 | Grard |
| 4,319,956 | A | 3/1982 | Snyder |
| 4,510,019 | A | 4/1985 | Bartelloni |
| 4,748,076 | A | 5/1988 | Saotome |
| 4,919,753 | A | 4/1990 | Johnson |
| 4,931,139 | A | 6/1990 | Phillips |
| 4,986,882 | A | 1/1991 | Mackey |
| 5,009,747 | A | 4/1991 | Viazmensky |
| 5,031,775 | A | 7/1991 | Kane |
| 5,094,717 | A | 3/1992 | Manning |
| 5,200,036 | A | 4/1993 | Noda |
| 5,200,037 | A | 4/1993 | Noda |
| 5,204,165 | A | 4/1993 | Schortmann |
| 5,217,772 | A | 6/1993 | Brown |
| 5,238,534 | A | 8/1993 | Manning |
| 5,294,301 | A | 3/1994 | Kumar |
| 5,308,691 | A | 5/1994 | Lim |
| 5,316,623 | A | 5/1994 | Espy |
| 5,418,022 | A | 5/1995 | Anderson |
| 5,451,456 | A | 9/1995 | Marchessault |
| 5,466,336 | A | 11/1995 | Kinsley, Jr. |
| 5,478,641 | A | 12/1995 | Schmeing |
| 5,595,828 | A | 1/1997 | Weber |

FOREIGN PATENT DOCUMENTS

| | | |
|---|---|---|
| WO | WO 88/03972 | 6/1988 |

*Primary Examiner*—Kim M. Lewis
(74) *Attorney, Agent, or Firm*—Nelson Mullins Riley & Scarborough

(57) ABSTRACT

A medical packaging substrate formed from a cellulosic pulp and/or synthetic fibers and a binder material is provided by the present invention. The substrate is usable to form medical packages for surgical instruments, medical devices, and medical appliances. The fabric is gas-pervious so that gas sterilization techniques may be used to sterilize the contents of any package made from the material. The substrate is manufactured using a latex deposition process wherein the binder material is applied prior to or during formation of the web.

13 Claims, No Drawings

MEDICAL PACKAGING FABRIC WITH IMPROVED BACTERIA BARRIER

CROSS-REFERENCE TO RELATED APPLICATION

This is a divisional application of prior application Ser. No. 09/080,759 filed May 18, 1998, now abandoned, entitled "Medical Packaging fabric with Improved Bacteria Barrier and Process for Making Same", of which this application claims parent benefit under 35 U.S.C. §120.

The present invention is based on provisional patent application Serial No. 60/051,241 filed Jun. 30, 1997, and priority is hereby claimed therefrom.

FIELD OF THE INVENTION

The present invention relates generally to fabrics useful in forming packages for the medical field, including packaging for medical instruments that require a sterilization process. More specifically, the present invention relates to an improved medical packaging substrate produced by combining wood pulp, synthetic fibers, latex, and various optional physical property-enhancing add-ons. The latex is applied to the fibers by a latex deposition process.

BACKGROUND OF THE INVENTION

Surgical instruments and devices and appliances must be sterilized prior to use. Such instruments and devices are often wrapped in a hospital surgical supply or central supply room prior to being sterilized. Typically, the packages, in which the instruments and devices are placed are made of a textile or nonwoven fabric which serves to protect the instruments during sterilization and to preserve their sterility upon subsequent storage until the packages are opened and the instruments used. Fabrics typically used in this area are either tightly woven textiles or nonwovens which possess a closed structure with certain porosity characteristics. (As used herein, the term "fabric" is intended to encompass any sheet-like or web material which is formed, in whole or in part, from a plurality of fibers.) The resulting packages usually take the form of bags, pouches, or the like.

The normal sterilization procedure used by hospitals and surgical supply rooms today involves using sterilizing materials, such which the surgical instruments or medical devices are maintained. The gas flows through the pores in the packaging material and sterilizes the instruments contained therein. Over time, the gas will diffuse out of the package. Other sterilization processes well known in the art have also been used to sterilize surgical instruments and medical devices.

Thus, a suitable fabric for packaging surgical instruments and medical devices must exhibit the combined effects of good permeability to steam, ethylene oxide, or Freon sterilizing gases while offering adequate bacterial filtration efficiency in order to prevent the entry of bacteria into the package. In addition to being permeable, the fabric should be strong and exhibit relatively high internal bonding, or delamination and tear resistances. The product should also possess a certain degree of fluid repellency to prevent further transmission of the bacteria. Other properties necessary for such packaging is that it be non-toxic in accordance with industry and federal guidelines, substantially lint-free, odor-free, and drapable.

In terms of permeability, a fabric's suitability as a bacteria barrier may be partially predicted by a cumulative pore number of at least 3 million pores per square centimeter. The cumulative pore number reflects the creation of surfaces that prohibit the passage of bacteria by enabling the bacteria to lodge on a surface and, thus, be trapped by the barrier. The greater the cumulative pore numbers, the greater possibility of bacteria lodging in a pore and not passing through the substrate.

Other desirable properties for suitable bacteria barrier fabrics include those normally desired in other fabrics for use in forming packages and coverings, including strength, particularly in terms of delamination and tear resistance, suppleness, drapability, smoothness, etc. Obviously, the inclusion of such characteristics will depend on the particular product for which the bacteria barrier fabric is to be used.

One example of these gas-pervious, bacteria-impervious materials which has certain of these properties is a spunbonded polyolefin material sold under the trademark TYVEK® by E.I. DuPont De Nemours & Co. TYVEK® is a lightly consolidated or unconsolidated fabric made from spun bonded sheets of flash-spun polyolefin (usually polyethylene or polypropylene) plexifilamentary film-fibril strands. The general procedure for manufacturing TYVEK® is disclosed in U.S. Pat. No. 3,169,898 to Steuber.

TYVEK® fabric exhibits high strength, as well as providing the necessary pore distribution to allow for sterilization processes to act on instruments contained within packaging made from the material. TYVEK® material acts as a barrier to particulate matter that is sub-micron in size. TYVEK®, however, is a purely synthetic material and lacks the qualities inherent in material made with cellulosic webs. Such characteristics include suppleness, softness, drapability, and ease of printing.

To form sterile packaging trays from bacteria barrier fabrics, a surgical device or medical appliance is placed in an impervious tray or tub and a layer of the gas-pervious, bacterial-impervious paper or plastic is sealed to flanged edges of the tray. The sealed package is then exposed to ethylene oxide which permeates the paper or plastic and sterilizes the contents of the package. Since the paper or plastic is designed to prevent the passage of bacteria, the contents of the package will remain sterile until the seal is broken. One such example of a needle/suture package is disclosed in U.S. Pat. No. 4,183,431 to Schmidt et al. Another package for housing a medical instrument is shown in U.S. Pat. No. 5,031,775 to Kane.

A high-strength porous material, such as TYVEK®, may also be used as the backing material for a medical packaging breather pouch. Such pouches generally have an outer layer of plastic film material heat sealed to the edges of a TYVEK® sheet to secure the medical instrument within the package. One such breather pouch is described in U.S. Pat. No. 5,217,772 to Brown et al.

U.S. Pat. No. 5,418,022 to Anderson et al, relates to a method of forming a pocket from a spunbonded olefin sheet and a microbial resistant package produced thereby. The package disclosed therein comprises a spunbonded olefin sheet material, such as TYVEK®, at least a portion of which has been stretched or thermally deformed.

Alternatives to DuPont's TYVEK® product have also been developed. In particular, medical packaging substrates consisting of paper-based webs that have been saturated with binders such as latex have also been used for packaging surgical instruments and medical devices. In some of these substrates, a synthetic staple fiber, such as polyester or nylon, is incorporated directly into the wood pulp furnish for forming the composite web. Latex, usually at a high add-on, is necessary in order to bind the synthetic fibers to the cellulose-based web because, otherwise, the fibers would tend to pick or pull out of the sheet with relative ease.

The synthetic fiber that is incorporated into the product increases the tear resistance of the medical packaging substrate but generally reduces delamination resistance and tensile strength. The add-on latex builds up the necessary delamination resistance to prevent the substrate from splitting during its end use.

The latex in these bacteria barrier products is normally applied by a saturation process which typically involves dipping the formed fabric web into a bath of latex or subjecting the fabric web to latex-saturated rollers. Alternatively, the webs are subjected to latex application while still on the forming web through the use of various emulsion processes and the like. In each of these previously known processes for forming bacteria barrier fabrics, the latex is applied to the fabric after the web has been formed and dried or after the web has been formed on the wire. Such processes where latex is applied to a formed web are generally referred to herein as "latex saturation" processes. The application of latex in this manner fills in many of the smaller (less than 1 micron) pores in the fabric, often reducing the permeability of the fabric.

Examples of such products include products designated as BP 388 and BP 321 which are available from Kimberly-Clark Corporation. These products are base papers that are typically used as medical packaging substrates and comprise various amounts of cellulosic pulps and synthetic latex. Although such products function well as medical packaging substrates, their permeability characteristics and tear, puncture, and delamination resistances could be improved.

U.S. Pat. No. 5,204,165 to Schortmann discloses a non-woven laminate having barrier properties which is described as being suitable for industrial, hospital, and other protective or covering uses. The laminate consists of at least one thermoplastic fiber layer bonded with a wet-laid fabric layer made from a uniform distribution of cellulose fibers, polymeric fibers, and a binder. In one embodiment, spunbond polyester fiber layers are ultrasonically bonded on each side of a wet-laid barrier fabric made of eucalyptus fibers and polyester fibers. The barrier fabric is bonded with an acrylic latex binder. The binder is added to the formed polymeric/cellulosic web after the web is formed. The binder may be added by any one of several methods, including foamed emulsion, gravure roll polymer emulsion, spraying, padding and nip-pressure binder pick-up. Schortmann is an example of a barrier fabric formed using a latex saturation process.

Another process for saturating a formed web with a latex binder is disclosed in U.S. Pat. No. 5,595,828 to Weber. A polymer-reinforced paper, which includes eucalyptus fibers, is disclosed. After forming the web from eucalyptus fibers and, optionally, other fibers such as non-eucalyptus cellulosic fibers and/or synthetic fibers, the web is saturated with a latex binder. Again, this particular latex-saturated fabric would be more suitable for use as a bacteria barrier if more of the pores remained open as opposed to being filled with binder material.

Although various processes are known for making papers using a latex deposition process wherein a binder material is precipitated onto the forming fibers prior to forming the paper sheet, such resulting products have not heretofore been generally used as forms of sterilizable medical packaging substrates. For example, U.S. Pat. No. 5,466,336 to Kinsley, Jr. describes a process for making a paper-based product comprising a paper sheet, an aqueous latex binder and a release agent. The product is made by preparing a slurry of cellulosic and/or synthetic pulp and a polymeric latex binder and then depositing the latex polymer particles onto the surface of the cellulosic fibers and adding an emulsion of lecithin and a fatty acid or fatty acid derivative. Coagulation of the latex into particles once in the slurry is promoted by agents such as alum or by altering the pH of the slurry. There is no indication, however, in Kinsley, Jr. that the resulting paper otherwise meets the requirements of a bacteria barrier fabric or is suitable for such use.

U.S. Pat. No. 4,178,205 to Wessling et al. also discloses a process for forming a high strength non-woven fibrous material prepared by mixing an aqueous slurry of negatively charged fiber with a specific type of cationic latex and then forming a web from that slurry. The fibers used include both natural and synthetic fibers. Like Kinsley, Jr., there is no teaching that the resulting material meets the requirements of a bacteria barrier fabric.

U.S. Pat. No. 4,510,019 to Bartelloni discloses a process for making paper by combining fibrous materials, a latex, and a bridging or cross-linking agent. The bridging or cross-linking agents, however, link or bridge the paper-making fibers to uncoagulated latex particles. In fact, the patent discloses that coagulation and precipitation of the latex is to be minimized and preferably prevented.

Despite the availability of several alternative bacteria barrier fabrics, a need still exists for further improved medical substrates that can be used in forming the packages for housing and sterilizing medical devices and surgical instruments until they are used. Such packaging must allow for known sterilization materials to enter into the package and sterilize the enclosed appliances while at the same time exhibit high strength, at least in terms of delamination and tear resistance.

SUMMARY OF THE INVENTION

It is an object of the present invention to provide an improved medical packaging substrate for housing surgical instruments, medical devices, medical appliances, and the like.

Another object of the present invention is to provide a substrate for use in medical packaging which provides the necessary tear, puncture, and delamination resistances while maintaining the ability to allow passage of sterilization gases therethrough.

It is a further object of the present invention to provide a barrier product sufficient to protect a medical device stored within the barrier product from bacterial contamination.

A further object of the present invention is to provide a process for producing a bacteria barrier fabric which results in a high strength fabric that exhibits suitable porosity characteristics sufficient for use as a medical packaging substrate.

Another object of the present invention is to provide a process which utilizes a latex deposition process to form a medical packaging substrate.

These and other objects are achieved by generally providing a medical packaging substrate constructed from wood pulp fibers and/or synthetic fibers, a binder material, and various strength-producing and water-resisting chemicals. More specifically, the present invention involves the formation of a medical packaging bacteria barrier fabric using a latex deposition process whereby a binder material, such as latex, is applied to a fabric web during or prior to formation of the web.

The use of the latex deposition process in forming the fabric, overcomes the problems encountered with latex saturation processes. The binder material is added to the web-forming slurry along with one or more deposition aids. The deposition aids promote coagulation and particle formation of the binder material so that the binder particles may attach to the fibers used in forming the web. The binder particles will attach themselves to the fibers when they contact the fibers.

When the web is then subsequently formed, the binder material does not substantially interfere with the pore structure of the web as it does when a latex saturation process is used to add the strengthening binder material to the web. Instead, the deposited binder material enhances delamination and tear resistance of the web by binding the fibers together without clogging the pores necessary for maintaining a suitable fabric permeability.

Other objects, features and aspects of the present invention are discussed in greater detail below.

DETAILED DESCRIPTION OF PREFERRED EMBODIMENT

It is to be understood by one of ordinary skill in the art that the present discussion is a description of exemplary embodiments only and is not intended as limiting the broader aspects of the present invention, which broader aspects are embodied in the exemplary construction.

Generally speaking, the present invention is a medical packaging substrate constructed from wood pulp fibers and/or synthetic fibers, a binder material, and various strength-producing and water-resisting chemicals. The substrate is produced using a latex deposition process instead of the widely used latex saturation process.

More specifically, the present invention involves the formation of a medical packaging bacteria barrier fabric using a latex deposition process whereby a binder material, such as latex, is applied to a fabric web during or prior to formation of the web. The binder material is added to the web-forming slurry along with one or more deposition aids. The deposition aids promote coagulation and particle formation of the binder material so that the binder particles may attach to the fibers used in forming the web. The binder particles will attach themselves to the fibers when they contact the fibers.

The web may be formed from cellulosic pulp fibers alone, synthetic fibers alone, or a mixture of cellulosic pulp and synthetic fibers. When used, the cellulosic pulp fiber component of the furnish for making the bacteria barrier web may include various woody and/or non-woody cellulosic fiber pulps. Pulp includes fibers from natural sources such as woody and non-woody plants. Woody plants include, for example, deciduous and coniferous trees. Non-woody plants include, for example, cotton, flax, esparto grass, milkweed, straw, jute hemp, and bagasse.

The pulp may be a mixture of different types and/or qualities of pulp fibers. For example, the invention may include a pulp containing more than about 50 percent by weight, low-average fiber length pulp and less than about 50 percent by weight, high-average fiber length pulp (e.g., virgin softwood pulp). The low-average fiber length pulp may be characterized as having an average fiber length of less than about 1.2 mm. For example, the low-average fiber length pulp may have a fiber length from about 0.7 mm to about 1.2 mm. The high-average fiber length pulp may be characterized as having an average fiber length of greater than about 1.5 mm. For example, the high-average fiber length pulp may have an average fiber length from about 1.5 mm to about 6 mm. The fiber mixture may contain about 75 percent, by weight, low-average fiber length pulp and about 25 percent, by weight, high-average fiber length pulp.

The low-average fiber length pulp may be certain grades of virgin hardwood pulp and secondary (i.e., recycled) fiber pulp from sources such as, for example, newsprint, reclaimed paperboard, and office waste. The high-average fiber length pulp may be bleached and/or unbleached virgin softwood pulps.

In accordance with the present invention, any of the various wood and nonwood pulps and other cellulosic fibers may be incorporated into the pulp furnish. Illustrative examples of suitable lignocellulosic pulps include southern pines, northern softwood kraft pulps, red cedar, hemlock, black spruce and mixtures thereof. Exemplary high-average fiber length wood pulps include those available from the Kimberly-Clark Corporation under the trade designations Longlac 19 and Coosa River 55.

Other various cellulosic fibers that may be used in the present invention include eucalyptus fibers, such as Aracruz Eucalyptus, and other hardwood pulp fibers available under the trade designations Coosa River 57, Longlac 16 and Quinuesco. Obviously, other cellulosic fibers may be utilized in the present invention, depending on the particular characteristic desired in the bacteria barrier.

In one particular embodiment of the present invention, a pulp mixture utilizing a eucalyptus pulp and a high average fiber length pulp is utilized. In particular, a 75% by weight amount of Aracruz Eucalyptus and a 25% by weight amount of Longlac 19 are combined into the pulp mixture for formation of the bacteria barrier web in this embodiment.

Refinement of the pulp is necessary in order to obtain a web possessing the properties necessary to use the web as a bacteria barrier. In particular, refinement of the pulp is carried out by beating or otherwise agitating the cellulosic material until the material is sufficiently separated into relatively individual pulp fibers. Such refinement may be carried out by any number of various known methods such as in commercial grade pulp beaters. Such refining processes are within the known skill in the art.

The more highly refined pulps result in more effective bacteria barriers. This is because the use of individualized pulp fibers will form a web having many circuitous and tortuous pore channels. Obviously, the more tortuous a pore channel path is, the less likely bacteria will be able to navigate the channel and permeate through the web. As indicated above, suitability as a bacteria barrier fabric can generally be determined by cumulative pore number, with 3 million per square centimeter being acceptable for such products. In addition, webs having a log reduction value (LRV) of two or above are generally suitable as bacteria barriers. The higher the estimated LRV, the greater the bacteria barrier properties. For example, an LRV change from 1 to 2 indicates a ten times improvement in the barrier. Although lower LRVs are acceptable, producers of medical packagings generally find substrates having an LRV of 3 or higher to be especially suitable.

When processing a chosen pulp to be used in the present fabric, the amount of refinement is determined by the desired cumulative pore number and other barrier properties. The following Table indicates how various refinement parameters affect pore size, cumulative pore size, and estimated LRVs in webs formed from the listed pulps. The pulps listed were subjected to a refinement beater known as a PFI Mill, available from Lorenteen and Wettre, at the indicated revolutions. Tensile strength is shown in kg/15 mm. Canadian Standard Freeness (CSF) is shown in milliliters and basis weight (B.W.) in grams per square meter. Thickness or caliper is shown in millimeters and the density is shown in grams per cubic centimeter. The pore size is indicated in microns, with a maximum and a minimum and a mean flow pore size (MFP). MFP indicates the pore size at a 50% air throughput level. The estimated LRVs are shown in Table 1.

TABLE 1

| Pulp | Revolutions (PFI mill) | Tensile Sum | CSF ml | B.W. ($g/m^2$) | Caliper (mm) | Density (g/cc) | Porosity sec/1 sht | Pore Size, Microns Max. | Min. | MFP | Cumulative Pore No. | Est. LRV |
|---|---|---|---|---|---|---|---|---|---|---|---|---|
| Aracruz | 250 | 0.20 | 622 | 56.6 | 0.1397 | 0.405 | 0.5 | 17.7 | 6.8 | 9.9 | $8.44 \times 10^5$ | 1.6 |
| | 1000 | 0.42 | 595 | 55.0 | 0.1295 | 0.425 | 0.6 | 17.7 | 6.0 | 9.1 | $1.01 \times 10^6$ | 1.8 |
| | 4000 | 0.56 | 578 | 53.3 | 0.1118 | 0.477 | 0.9 | 14.3 | 6.0 | 8.3 | $1.29 \times 10^6$ | 1.8 |
| | 6000 | 0.82 | 359 | 56.8 | 0.0940 | 0.604 | 5.2 | 8.6 | 2.1 | 3.3 | $4.85 \times 10^6$ | 2.8 |
| | 8000 | 0.89 | 302 | 56.9 | 0.0965 | 0.590 | 10.5 | 5.6 | 1.4 | 2.5 | $9.14 \times 10^6$ | 3.3 |
| | 10,000 | 1.02 | 196 | 39.7 | 0.0635 | 0.625 | 28.0 | 5.1 | 1.4 | 1.8 | $1.01 \times 10^7$ | 3.4 |
| | 13,000 | 1.14 | 148 | 43.8 | 0.0686 | 0.639 | 82.0 | 2.8 | 0.8 | 1.3 | $1.31 \times 10^7$ | 3.6 |
| Leaf | 250 | 0.21 | 758 | 56.3 | 0.1702 | 0.331 | 0.2 | >300 | 13.8 | 30.2 | $8.21 \times 10^4$ | 0.0 |
| River | 1000 | 0.44 | 740 | 65.0 | 0.1549 | 0.420 | 0.3 | 54.6 | 10.3 | 19.0 | $2.60 \times 10^5$ | 0.7 |
| 90 | 4000 | 0.69 | 680 | 60.3 | 0.1219 | 0.495 | 0.9 | 72.1 | 8.0 | 13.8 | $2.86 \times 10^5$ | 0.8 |
| | 6000 | 0.92 | 526 | 56.3 | 0.1067 | 0.528 | 3.1 | 56.4 | 2.9 | 6.4 | $1.07 \times 10^6$ | 1.8 |
| | 8000 | 0.85 | 463 | 54.5 | 0.0991 | 0.551 | 4.2 | 50.0 | 2.1 | 5.4 | $2.49 \times 10^6$ | 2.4 |
| | 10,000 | 0.94 | 353 | 60.9 | 0.0991 | 0.615 | 50.0 | 12.3 | 1.4 | 2.5 | $3.84 \times 10^6$ | 2.7 |
| LL-16 | 100 | 0.30 | 675 | 61.1 | 0.1219 | 0.501 | 0.9 | 19.3 | 5.6 | 8.7 | $9.74 \times 10^5$ | 1.7 |
| | 250 | 0.35 | 663 | 57.3 | 0.1194 | 0.480 | 0.9 | 23.3 | 6.2 | 9.0 | $1.00 \times 10^6$ | 1.7 |
| | 500 | 0.49 | 637 | 54.7 | 0.1219 | 0.449 | 1.1 | 16.1 | 5.2 | 7.9 | $1.38 \times 10^6$ | 1.8 |
| | 1000 | 0.56 | 617 | 57.8 | 0.1041 | 0.555 | 2.2 | 16.1 | 5.0 | 7.3 | $7.47 \times 10^6$ | 1.6 |
| | 2000 | 0.65 | 562 | 48.0 | 0.0813 | 0.591 | 3.6 | 20.5 | 3.0 | 5.0 | $1.70 \times 10^6$ | 2.1 |
| | 4000 | 0.99 | 414 | 51.6 | 0.0864 | 0.597 | 20.0 | 8.3 | 1.6 | 2.3 | $3.28 \times 10^6$ | 2.6 |
| Harmac | 100 | 0.19 | 700 | 55.9 | 0.1549 | 0.361 | 2.1 | 23.3 | 4.9 | 7.7 | $1.32 \times 10^6$ | 1.8 |
| K-10 | 250 | 0.29 | 740 | 54.9 | 0.1321 | 0.416 | 1.7 | 21.4 | 5.2 | 8.1 | $8.29 \times 10^5$ | 1.6 |
| | 500 | 0.43 | 670 | 57.8 | 0.1219 | 0.474 | 2.5 | 22.3 | 4.1 | 7.2 | $9.69 \times 10^5$ | 1.6 |
| | 1000 | 0.56 | 670 | 54.3 | 0.1168 | 0.465 | 4.5 | 15.6 | 2.5 | 4.9 | $2.31 \times 10^6$ | 2.3 |
| | 4000 | 0.87 | 552 | 55.0 | 0.0914 | 0.601 | 11.0 | 12.3 | 1.4 | 2.5 | $3.86 \times 10^6$ | 2.7 |
| | 5000 | 1.03 | 518 | 49.9 | 0.0914 | 0.546 | 24.6 | 13.9 | 1.8 | 3.2 | $2.68 \times 10^6$ | 2.4 |
| LL-19 | 8000 | 1.24 | 414 | 49.1 | 0.0787 | 0.624 | 14.6 | 16.1 | 1.8 | 2.9 | $2.46 \times 10^6$ | 2.4 |

The furnish may also include, or be made from 100% of, synthetic fibers such as rayon fibers, polyvinyl alcohol fibers, ethylene vinyl alcohol copolymer fibers, and various polyolefin fibers. Suitable polymeric fibers for use in the present invention include fibers made from polyolefins, polyesters, polyamides, and copolymers and blends thereof. Polyolefins suitable for the fibers include polyethylene, e.g., high density polyethylene, medium density polyethylene, low density polyethylene and linear low density polyethylene; polypropylene, e.g., isotactic polypropylene, syndiotactic polypropylene, blends thereof, and blends of isotactic polypropylene and atactic polypropylene; polybutylene, e.g., poly(1-butene) and poly(2-butene); polypentene, e.g., poly(1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Polyamides suitable for the fibers include nylon 6, nylon 6/6, nylon 4/6, nylon 11, nylon 12, nylon 6/10, nylon 6/12, nylon 12/12, copolymers of caprolactam and alkaline oxide diamine, and the like, as well as blends and copolymers thereof. Suitable polyesters include polyethylene terephthalate, polybutylene terephthalate, polytetramethylene terephthalate, polycyclohexylene-1,4-dimethylene terephthalate, and isophthalate copolymers thereof, as well as blends thereof. Of these suitable polymers, more desirable polymers are polyolefins, most desirably polyethylene and polypropylene, because of their commercial availability and importance, as well as their chemical and mechanical properties.

In addition, bicomponent fibers may be utilized in addition to the cellulosic fibers and unitary synthetic fibers and are, in some embodiments, preferred. Bicomponent fibers are multicomponent fibers wherein two fibers having differing characteristics are combined into a single fiber. Bicomponent fibers generally have a core and sheath structure where the core is a polyester and the sheath is a polyolefin. Other bicomponent fiber structures, however, may also be utilized. For example, bicomponent fibers may be formed with the two components residing in various side-by-side relationships as well as concentric and eccentric core and sheath configurations.

When used, bicomponent fibers aid in increasing the strength of the web. The outer sheath of the bicomponent fiber should be capable of adhering to cellulosic fibers so that the structure of the web is reinforced through their use. One particular example of a suitable bicomponent fiber is sold under the name "Celbond T255" by Hoechst Celanese. Celbond T255 is a synthetic polyester/polyethylene bicomponent fiber which is capable of adhering to cellulosic fibers when its outer sheath is melted at a temperature of approximately 128° C.

Various binder materials may be used in the present inventive process. Any of the latex binders commonly employed for reinforcing paper can be utilized and are well known to those having ordinary skill in the art. Suitable binders include, by way of illustration only, polyacrylates, including polymethacrylates, poly(acrylic acid), poly (methacrylic acid), and copolymers of the various acrylate and methacrylate esters and the free acids; styrene-butadiene copolymers; ethylene-vinyl acetate copolymers; nitrile rubbers or acrylonitrile-butadiene copolymers; poly(vinyl chloride); poly(vinyl acetate); ethylene-acrylate copolymers; vinyl acetate-acrylate copolymers; neoprene rubbers or trans-1 ,4-polychloroprenes; cis-1,4-polyisoprenes; butadiene rubbers or cis- and trans-1,4-polybutadienes; and ethylene-propylene copolymers.

Specific examples of commercially available latex binders are set forth as examples in Table 2 below:

TABLE 2

Suitable Latexes for Deposition

| Polymer Type | Product Identification |
|---|---|
| Polyacrylates | Hycar ® 26083, 26084, 26120, 26104, 26106, 26322, 26469<br>B. F. Goodrich Company<br>Cleveland, Ohio<br>Rhoplex ® HA-8, HA-12, HA-16 NW-1715, B-15<br>Rohm and Haas Company<br>Philadelphia, Pennsylvania<br>Carboset ® XL-52<br>B. F. Goodrich Company<br>Cleveland, Ohio |
| Styrene-butadiene copolymers | Butofan ® 4264, 4262<br>BASF Corporation<br>Sarnia, Ontario, Canada<br>DL-219, DL-283, DL-239<br>Dow Chemical Company<br>Midland, Michigan |
| Nitrile rubbers | Hycar ® 1572, 1577, 1570X55, 1562X28<br>B. F. Goodrich Company<br>Cleveland, Ohio |
| Poly(vinyl chloride) | Vycar ® 352, 552<br>B. F. Goodrich Company<br>Cleveland, Ohio |
| Ethylene-acrylate copolymers | Michem ® Prime 4990<br>Michelman, Inc.<br>Cincinnati, Ohio<br>Adcote 56220<br>Morton Thiokol, Inc.<br>Chicago, Illinois |
| Vinyl acetate-acrylate copolymers | Xlink 2833<br>National Starch & Chemical Co.<br>Bridgewater, New Jersey |

In making the web of the present invention, a pulp furnish is formed according to normal procedures. The furnish may consist of only cellulosic pulp fibers, only synthetic fibers, or a mixture of cellulosic pulp fibers and synthetic fibers. A binder material, such as one or more of the above-described latex materials, is added to the furnish so that the binder material is "deposited" onto the fibers. Various deposition aids may be added to the furnish to assist in coagulation of the binder material into particles and in attaching the binder material particulates to the fibers.

Deposition of the binder material onto the fibers while in the furnish in this invention is in contrast to the latex saturation process previously used to create bacteria barriers. During such latex saturation processes, binder materials are applied to the web after it is formed. In the present deposition process, the binder material adheres to the fibers as small "adhesive-like" balls or particles before the paper is formed and dried. This process allows the pores to remain relatively unobstructed whereas latex saturation processes tend to close a number of the smaller pores by forming a film on the web. The latex saturation processes result in a less than perfect bacteria barrier substrate.

Among the various deposition aids which may be used include Alum, Kymene 736, Nalco 7607, Parez 631NC, and Kymene 557LX.

The web is made from the furnish according to known papermaking processes.

Various other additives may also be used in the bacteria barrier-making process. For example, sizing agents to impart water resistance, wet-strength agents to improve delamination resistance, and other agents may be added either to the furnish or to the formed web. One such exemplary sizing agent is Aquapel 752 and one such exemplary wet-strength agent is Parez 631NC. Other agents, include, by way of example only, starches and dry-strength resins which also enhance the physical properties of the web by increasing the delamination resistance of the final product. One such exemplary starch is a cationic potato starch sold under the designation Astro X-200 and one such exemplary dry-strength resin is Accostrength 85. Cross-linking agents and/or hydrating agents may also be added to the pulp furnish.

Optionally, the fabric formed from the present process may be calendered by known processes using steel calendering rolls. Calendering will add smoothness to the fabric. Processes such as "supercalendering," which uses a harder steel roll and a softer, polishing, roll, can also be used. In supercalendering, a high-gloss polish is created.

If so desired, the fabric so made may be treated with a separate bacteria barrier. One such exemplary bacteria barrier technique is provided by Rexam via their MICRO-MOD® process. This process involves subjecting the fabric to a technique which fills any large pores with particulates which act as a bacteria barrier. In addition, anti-microbial agents may be added to the pore-embedded particular matter so that anti-microbial activity will be exhibited by the fabric. Obviously, such techniques are not required if sufficiently refined pulp is used in making the web because the bacteria barrier properties relative to pore size and number will already be inherent in the product.

The fabric is then supplied to a maker of medical packaging which then transforms the fabric into the appropriate packaging necessary for storing medical devices and appliances and surgical instrumentation.

In order to make comparative tests to commercially available products used in medical packaging, the inventive substrate was made according to the following examples.

EXAMPLE 1

An Aracruz Eucalyptus virgin pulp in an amount of 75% by weight and a Longlac 19 virgin pulp were refined in a Valley beater to approximately 350 to 450 ml CSF. Commercial acrylic latex (Hycar 26796) was deposited onto the fibers at 15 to 20% bone dry weight of the fiber. Kymene 736, at 10 pounds per ton, and Nalco 7607, at 1 pound per ton, were used as deposition aids. The pulp was diluted to handsheet consistency. A neutral internal sizing agent (Aquapel 752) was added at 0.15 to 0.3% bone dry weight to impart water resistance to the web. Parez 631NC was added at 0.5 to 1.0% bone dry weight as wet-strength agent to improve delamination resistance of the web. The Aquapel and Parez additives were added at the handsheet mold instead of the size press because it was believed that saturation with these chemicals may have been detrimental to the bacteria barrier properties of the web. Celbond T255 (a synthetic polyester/polyethylene bicomponent fiber) was added to the handsheet mold at 5% bone dry weight to increase the delamination resistance of the web. The web was then wet pressed at about 600 psig for 5 minutes and dried on a steam-heated drum. The chemical additions of Aquapel and Parez were cured at 105° C. for 4 minutes. The Celbond was melted at 180° C. for 25 seconds. The formed sheets were steel calendered at 0 psig for 2 passes to a target Gurley porosity of 8 to 14 seconds per sheet. The target basis weight was 25 pounds per ream, conditioned.

EXAMPLE 2

The process of Example 1 was repeated in preparing another substrate except that Hycar 26410 was substituted for Hycar 26796 as the binder material and two additional wet-end additives were used to increase the delamination resistance of the sheet. Potato starch (Astro X-200) was applied at 20 pounds per ton and a dry-strength resin (Accostrength 85) was applied at 1% bone dry weight.

EXAMPLES 3–10

Additional handsheets were made for comparative purposes. Generally, the sheets were formed according to the process of Examples 1 and 2 except as follows. Example 3 was a control sheet with no latex application and no wet-strength additives. Example 4 utilized a latex saturation process wherein Hycar 26410 at 20 parts pick-up (ppu) was coated onto the formed web after drying. The additives for Examples 5–10 are indicated in Table 3 below. In Table 3, the basis weights (B.W.), caliper (in millimeters), density (in grams per cubic centimeter), porosity (in seconds per 100 cubic centimeters), tear strength (in grams), delamination strength (in grams per 15 mm), and the cumulative pore number (in exponential terms) are shown. The percentage reduction in cumulative pore number is relative to Example 3 which is the control sample with no latex addition.

In each of the Examples, the latex utilized was Hycar 26410 at 20 ppu (whether deposited or saturated); the wet strength agents were added at 1.0% bone dry weight; the basis weights are shown as conditioned weights; the pulp (75% Aracruz Eucalyptus/25% Longlac 19) used was refined to 420 milliliters CSF; wet pressing was performed at 500 psig; starch was added to the formed handsheet at 20 pounds per ton; talc was added at 6 pounds per ton and no polyvinyl alcohol fiber was used.

TABLE 3

| Example | Latex Appl. | Wet Strength Type | Wet Strength Appl. | Second Dep. Agent | B.W. #/R | Cal. mm | Dens. g/cc | Poros. sec | Tear g | Delam. g | Cumulative Pore No. (% red) |
|---|---|---|---|---|---|---|---|---|---|---|---|
| 3 | None | None | None | None | 23.2 | 0.1422 | 0.6313 | 14 | 125 | 128 | $1.39 \times 10^7$ |
| 4 | Saturate | None | None | None | 22.0 | 0.129 | 0.6783 | 12 | 90 | 290 | $2.79 \times 10^6$ (−80%) |
| 5 | Deposit | None | None | Kymeme 557LX | 23.8 | 0.1270 | 0.7045 | 14 | 100 | 341 | $1.14 \times 10^7$ (−18%) |
| 6 | Deposit | Kymeme 736 | Saturate | Kymeme 557LX | 24.1 | 0.1270 | 0.7133 | 14 | 99 | 347 | $7.42 \times 10^6$ (−47%) |
| 7 | Deposit | Parez 631NC | Saturate | Kymeme 557LX | 23.9 | 0.1321 | 0.6802 | 11 | 94 | 341 | $5.26 \times 10^6$ (−62%) |
| 8 | Deposit | Parez 631NC | Wet-end | Kymeme 557LX | 24.0 | 0.1321 | 0.6831 | 14 | 98 | 367 | $9.14 \times 10^6$ (−34%) |
| 9 | Deposit | Kymeme | Wet-end | Kymeme 557LX | 23.7 | 0.1321 | 0.6745 | 11 | 104 | 321 | $9.03 \times 10^6$ (−35%) |
| 10 | Deposit | Parez | Wet-end | Nalco 7607 | 22.9 | 0.1270 | 0.6778 | 15 | 96 | 377 | $9.35 \times 10^6$ (−33%) |

EXAMPLES 11–21

In the Examples summarized in Tables 4a and 4b below, the effects of the use of bicomponent fibers at the handsheet mold to form the bacteria barrier properties of various sheets made according to the process described in Example 1 are shown. As in Example 1, each of the sheets in Examples 11–20 comprise 75% eucalyptus and 25% softwood fibers. In Examples 11–16, no bicomponent fibers were added. In Examples 17–18, bicomponent fibers (Celbond T255) in an amount of 2.5% bone dry weight were utilized and in Examples 19–20, the same bicomponent fibers were added in an amount of 5.0% bone dry weight. Example 21 is BP388, which is a commercial base paper available from Kimberly-Clark and which has been used as a medical packaging component (or substrate) as described above. Obviously, Example 21 has not been prepared according to the present invention.

Table 4a reflects the percentage of wet strength agent (Kymene 557XL), percentage of Aquapel 752, whether the sheet was oven aged at 105° C. for 4 minutes, the maximum and minimum pore sizes, the mean flow pore size, the cumulative pore number, the estimated LRV, the smoothness of the sheet in Sheffield units (s.u.) and the opacity (which is 100 times the ratio of light reflected by a paper specimen when the specimen is backed by a black body of 0.5% reflectance or less to that when the specimen is backed by a thick stack of the same type of paper specimens). In addition, Table 4b presents the basis weights, caliper, porosity, cobb size (indicative of the ability to repel water or prevent water from being absorbed) in grams of water at 5 minutes per 20 milliliters of water, porosity, wet tensile strength at 10 seconds, stretch percentage, tear strength and delamination strength.

TABLE 4a

| Example | Wet Strength (%) | Aquapel (%) | Oven Aged? | Pore Size, microns Max | Min | MFP | Cumulative Pore No. | Est. LRV | Smoothness (s.u.) | Opacity (%) |
|---|---|---|---|---|---|---|---|---|---|---|
| 11 | 0 | 0 | yes | 7.5 | 1.4 | 2.7 | $1.26 \times 10^7$ | 3.5 | 280 | 83.7 |
| 12 | 0 | 0.15 | yes | 10.2 | 1.9 | 3.3 | $8.21 \times 10^6$ | 3.3 | 280 | 84.5 |
| 13 | 0 | 0.30 | yes | 7.5 | 1.6 | 2.7 | $1.09 \times 10^7$ | 3.5 | 225 | 84.8 |
| 14 | 0 | 0.30 | no | 10.4 | 2.2 | 3.5 | $5.55 \times 10^6$ | 3.0 | 260 | 83.8 |
| 15 | 0.5 | 0.30 | yes | 11.4 | 2.2 | 3.7 | $5.45 \times 10^6$ | 3.0 | 300 | 84.9 |
| 16 | 0.5 | 0.30 | no | 13.7 | 2.7 | 4.5 | $3.26 \times 10^6$ | 2.8 | 290 | 84.4 |
| 17 | 0 | 0.30 | yes | 15.8 | 2.4 | 4.5 | $4.14 \times 10^6$ | 2.8 | 340 | 85.2 |
| 18 | 0.5 | 0.30 | yes | 14.0 | 2.5 | 4.5 | $3.74 \times 10^6$ | 2.8 | 320 | 85.4 |
| 19 | 0 | 0.30 | yes | 13.5 | 2.8 | 3.8 | $6.27 \times 10^6$ | 3.1 | 335 | 85.0 |
| 20 | 0.5 | 0.30 | yes | 11.2 | 1.9 | 3.6 | $6.08 \times 10^6$ | 3.1 | 370 | 85.6 |

TABLE 4a-continued

| Example | Wet Strength (%) | Aquapel (%) | Oven Aged? | Pore Size, microns Max | Min | MFP | Cumulative Pore No. | Est. LRV | Smoothness (s.u.) | Opacity (%) |
|---|---|---|---|---|---|---|---|---|---|---|
| 21 (BP388) | — | — | — | 25.5 | 2.7 | 9.6 | $3.40 \times 10^5$ | 0.9 | 240/220 | 84.0 |

TABLE 4b

| Example | B.W (#/R) | Caliper (mil) | Porosity (sec/l) | Cobb Size (g H20) | Tensile (kg) | W. Tensile (kg) | Stretch (%) | Tear (g) | Delamin. (g) |
|---|---|---|---|---|---|---|---|---|---|
| 11 | 23.8 | 5.7 | 15 | 1.6 | 7.8 | 0.5 | 4.6 | 108 | 320 |
| 12 | 24.4 | 5.6 | 8 | 0.7 (−55%) | 7.7 | 0.6 | 3.9 | 108 | 310 |
| 13 | 24.1 | 5.6 | 13 | 0.3 (−81%) | 7.6 | 0.6 | 4.4 | 109 | 305 |
| 14 | 23.8 | 5.7 | 8 | 0.4 (−78%) | 6.7 | 0.5 | 3.6 | 110 | 285 |
| 15 | 25.3 | 6.0 | 7 | 0.3 (−81%) | 8.5 | 1.0 | 4.5 | 107 | 320 |
| 16 | 24.6 | 6.1 | 6 | 0.3 (−81%) | 7.5 | 0.9 | 3.6 | 114 | 285 |
| 17 | 25.8 | 6.6 | 5 | 0.3 (−81%) | 7.8 | 1.3 | 3.9 | 130 | 340 |
| 18 | 24.5 | 6.2 | 6 | 0.3 (−81%) | 8.7 | 1.6 | 4.3 | 121 | 355 |
| 19 | 24.4 | 6.3 | 7 | 0.3 (−81%) | 8.0 | 1.5 | 4.8 | 124 | 340 |
| 20 | 26.5 | 6.6 | 7 | 0.3 (−81%) | 8.9 | 2.1 | 5.3 | 129 | 395 |
| 21 (BP388) | 22.6 | 4.4 | 6 | 0.22 | 8.6/5.8 | 1.9/1.9 | 2.9/8.5 | 60/65 | 370 |

In Examples 22 and 23, the wet pressing effects on LRV were measured. In these Examples, a sheet made according to the process of Example 1 were made with the characteristics shown below in Table 5. The effects of wet pressing at 400 psig and at 1000 psig are shown.

TABLE 5

| Example | Wet Pressing (psig) | B.W. (#/R) | Caliper (mil) | Porosity (sec/1sht) | Delamin. (g) | Est. LRV |
|---|---|---|---|---|---|---|
| 22 | 400 | 22.1 | 5.4 | 11 | 320 | 3.2 |
| 23 | 1000 | 23.3 | 5.1 | 16 | 350 | 3.8 |

The bacteria barrier of the present invention was then compared to previously known substrates that are typically used as bacteria barriers. The inventive substrate was prepared according to the process of Example 1 and then compared to the listed base papers (BP designations) available from Kimberly-Clark and TYVEK® from DuPont. The results of those comparisons are listed in Table 6.

In Table 6, the basis weight, caliper, porosity, cumulative pore number, estimated LRV, Nelson Bacterial Filtration Efficiency (BFE) (determined at 3 M spores/cm$^3$ at 28 l/m flow rate) and the actual LRV's measured according to ASTM 2.6 (determined at 1 MM spores/cm$^3$ at 2.8 l/min. flow rate).

TABLE 6

| Description | B.W. (#/R) | Caliper (mil) | Porosity (sec/1 sht) | Regression Model Cumulative Pore No. | Estimated LRV | Nelson BFE (%) | LRV (ASTM) |
|---|---|---|---|---|---|---|---|
| BP 388 | 22.6 | 4.6 | 8 | $6.34 \times 10^5$ | 1.3 | 82.8 | 1.33 |
| BP 394 | 24.6 | 5.6 | 39 | $1.65 \times 10^6$ | 2.1 | 99.4 | 2.16 |
| Tyvek | — | 8.0 | 18 | $7.15 \times 10^6$ | 3.2 | 99.8 | 5.09 |
| Example 1 | 22.0 | 5.0 | 17 | $1.00 \times 10^7$ | 3.4 | 99.8 | 3.04 |

The following test methods were employed to determine various reported characteristics and properties. ASTM refers to the American Society for Testing and Materials.

Where applicable in the tables above, the porosity was determined pursuant to the Gurley Hill Porosity test according to ASTM D-726-84. The basis weight was determined by ASTM D-3776-85 and is reported in pounds per ream. Tear strengths are reported in grams and were performed in accordance with the Elmendorf Tear Test, ASTM D689. The tensile strength is reported in kilograms per 15 millimeters and was determined by application on an Instron machine according to ASTM D828. The percentage of stretch was determined by ASTM D828. The cumulative pore number is given in exponential terms as pores per square centimeters. Pore size was determined using a Coulter Porometer commercially available from Coulter Electronics, Ltd., Luton Beds, England. The sample to be analyzed was thoroughly wetted so that all accessible pores were completed filled with liquid. The wetted sample was then placed in the sample body of the filter holder assembly, secured with a locking ring and the pore size value was accorded. The values are reported in microns for the maximum, minimum and mean flow pore size distribution.

Where applicable in the examples above, delamination was determined according to the following procedure. First, sample strips of the substrate were cut to dimensions of 2½ inches×7½ inches long grain (7½ inch in the machine direction). Two strips were cut per sample. An electric hot plate having a six-inch wide solid steel top was then heated to 312° F. (156° C.) and a piece of steel plate (1½ inch×6 inches×1½ inches) with an insulated handle in the center (weight 2640 grams which was equal to 0.9692 psi) was placed on top of the hot plate and preheated to 312° F. (156° C.). A ⅛ inch strip of Ideal "black" paper delamination tape (1 inch wide) was placed on each side of the sample to be tested, with one superimposed upon the other, in the long grain direction of the sample. The tape was not preheated. The sample was then pressed between the hot plate and the steel plate for 20 seconds at 312° F. (156° C.), leaving 1 inch of tape on each end unpressed. The samples were then cooled and trimmed to 15 mm wide, ensuring that each edge of the Ideal tape was equally trimmed. An Instron tensile tester model TM-M was then calibrated and set up with a cross head speed of 30 cm/min; a chart speed of 3 cm/min; and a full scale load of 2 kilograms. Delamination resistance was then determined using the Instron in an attempt to delaminate the sample substrate being tested. Delamination is expressed in the tables above in grams per 15 mm.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit and scope of the present invention which is set forth in the following claims. In addition, it should be understood that aspects of the various embodiments may be interchanged, both in whole or in part.

What is claimed is:

1. A bacteria barrier substrate having a cumulative pore number of at least 3 million pores per square centimeter, said substrate comprising refined pulp fibers and a binder material.

2. The bacteria barrier substrate of claim 1, further comprising synthetic fibers.

3. The bacteria barrier substrate of claim 2, wherein said synthetic fibers comprise bicomponent fibers.

4. The bacterial barrier substrate of claim 1, wherein said synthetic fibers comprise bicomponent fibers.

5. The bacteria barrier substrate of claim 1, wherein said refined pulp fibers comprise eucalyptus fibers.

6. The bacteria barrier substrate of claim 1, wherein said refined pulp fibers have a Canadian Standard Freeness of between about 300 ml to about 450 ml.

7. The bacteria barrier substrate of claim 1, wherein said binder material is a latex binder.

8. The bacteria barrier substrate of claim 1, wherein said binder material is chosen from the group consisting of polyacrylates, including polymethacrylates, poly(acrylic acid), poly(methacrylic acid), and copolymers of the various acrylate and methacrylate esters and the free acids; styrene-butadiene copolymers; ethylene-vinyl acetate copolymers; nitrile rubbers or acrylonitrile-butadiene copolymers; poly-vinyl chloride); poly(vinyl acetate); ethylene-acrylate copolymers; vinyl acetate-acrylate copolymers; neoprene rubbers or trans-1,4-polychloroprenes; cis-1,4-polyisoprenes; butadiene rubbers or cis-and trans-1,4-polybutadienes; and ethylene-propylene copolymers.

9. The bacteria barrier substrate of claim 1, wherein said refined pulp fibers comprise secondary fibers.

10. The bacteria barrier substrate of claim 1, wherein said bacteria barrier substrate exhibits a log reduction value of at least 2.

11. The bacteria barrier substrate of claim 1, wherein said bacteria barrier substrate exhibits a log reduction value of at least 3.

12. A bacteria barrier substrate having a cumulative pore number of at least 3 million pores per square centimeter made according to a bacteria barrier substrate comprising the steps of:

a) forming a furnish comprising refined fibers suitable for forming a bacteria barrier substrate;

b) adding a binder material to said furnish under conditions sufficient to allow the binder material to be deposited onto said fibers;

c) forming a web from said furnish; and d) drying said web so as to form a bacteria barrier substrate.

13. A sterilizable bacteria wrap comprising a bacteria barrier substrate having a cumulative pore number of at least 3 million pores per square centimeter, said substrate comprising refined pulp fibers and a binder material.

* * * * *